US009188319B2

(12) United States Patent
Nakagawa et al.

(10) Patent No.: US 9,188,319 B2
(45) Date of Patent: Nov. 17, 2015

(54) LIGHTING DEVICE

(75) Inventors: Yuji Nakagawa, Osaka (JP); Tomohiro Ikawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 127 days.

(21) Appl. No.: 14/118,644

(22) PCT Filed: May 31, 2012

(86) PCT No.: PCT/JP2012/003611

§ 371 (c)(1), (2), (4) Date: Nov. 19, 2013

(87) PCT Pub. No.: WO2012/164953

PCT Pub. Date: Dec. 6, 2012

(65) Prior Publication Data

US 2014/0078734 A1 Mar. 20, 2014

(30) Foreign Application Priority Data

May 31, 2011 (JP) ..... 2011-122301

(51) Int. Cl.

| | |
|---|---|
| ***F21S 4/00*** | (2006.01) |
| ***F21V 21/14*** | (2006.01) |
| ***F21V 19/00*** | (2006.01) |
| *F21S 8/02* | (2006.01) |
| *F21Y 101/02* | (2006.01) |
| *F21Y 105/00* | (2006.01) |

(52) U.S. Cl.

CPC ..... *F21V 21/14* (2013.01); *F21V 19/004* (2013.01); *F21S 8/026* (2013.01); *F21Y 2101/02* (2013.01); *F21Y 2105/001* (2013.01)

(58) Field of Classification Search

CPC ... F21V 17/162; F21V 19/001; F21V 19/004; F21S 8/026; F21Y 2101/02

USPC ..... 362/235, 249.02

See application file for complete search history.

(56) References Cited

U.S. PATENT DOCUMENTS

| | | | | |
|---|---|---|---|---|
| 7,441,933 | B2 * | 10/2008 | Tsukamoto et al. | 362/548 |
| 7,549,786 | B2 * | 6/2009 | Higley et al. | 362/646 |
| 7,674,003 | B2 * | 3/2010 | Sharrah et al. | 362/205 |
| 8,109,652 | B2 * | 2/2012 | Chen | 362/249.02 |
| 8,232,724 | B2 * | 7/2012 | Mostoller et al. | 313/512 |
| 2012/0081634 | A1 | 4/2012 | Yokota | |

(Continued)

FOREIGN PATENT DOCUMENTS

| | | |
|---|---|---|
| FR | 2922295 | 4/2009 |
| JP | 2006-172895 | 6/2006 |

(Continued)

OTHER PUBLICATIONS

Search report from E.P.O., mail date is Sep. 3, 2014.

*Primary Examiner* — Anabel Ton

(74) *Attorney, Agent, or Firm* — Greenblum & Bernstein, P.L.C.

(57) ABSTRACT

A lighting device includes: a device main body; an LED unit which is mounted on a bottom surface of the device main body and which includes a plurality of LEDs which are mounted on a plurality of LED circuit boards; an optical member which is mounted on the device main body on a front side of the LED unit; and an LED circuit board pressing spring which supports the LED circuit boards in the device main body.

10 Claims, 12 Drawing Sheets

(56) References Cited

U.S. PATENT DOCUMENTS

| | | | |
|---|---|---|---|
| 2012/0086884 | A1 | 4/2012 | Yoshikawa |
| 2012/0147592 | A1 | 6/2012 | Takase |
| 2012/0161194 | A1 | 6/2012 | Matsuda et al. |

FOREIGN PATENT DOCUMENTS

| | | |
|---|---|---|
| JP | 2007-194188 | 8/2007 |
| JP | 2009-129809 | 6/2009 |
| JP | 2010-009950 | 1/2010 |
| JP | 2010-278127 | 12/2010 |
| JP | 2011-023140 | 2/2011 |
| WO | 2007/128070 | 11/2007 |
| WO | 2010/146914 | 12/2010 |
| WO | 2010/146918 | 12/2010 |
| WO | 2011-024861 | 3/2011 |
| WO | 2011/027588 | 3/2011 |

* cited by examiner

LIGHTING DEVICE

TECHNICAL FIELD

The present invention relates to a lighting device which is applied to, for example, a downlight installed into a storing hole opened in a ceiling material.

BACKGROUND ART

In related art, a lighting device is known, which includes a device main body which accommodate therein a mounting plate, a terminal block and a connector, wherein a light source block including an LED circuit board and a lens element which serves as an optical member, a lighting controller and a heat conducting sheet are mounted on the mounting plate (for example, refer to Patent Document 1).

In Patent Document 1, in a state in which a surface of the LED circuit board on which LEDs are mounted is oriented downward the LED circuit board is brought into contact with a lower surface portion of the mounting plate via the heat conducting sheet, and the lens element is disposed on the lower surface portion of the mounting plate so as to accommodate the LED circuit board in an accommodating portion of the lens element such that the LEDs correspond to respective recess portions of the lens element.

In Patent Document 1, the lens element is mounted on the mounting plate by inserting screws through cutouts formed in projecting pieces of the lens element via a spacer and a packing, and screwing the screws into a pair of screw holes formed in the mounting plate so as to correspond to the screws.

RELATED ART DOCUMENTS

Patent Documents

Patent Document 1: JP-A-2006-172895 (FIG. 3, paragraphs 0035, 0036)

SUMMARY OF THE INVENTION

Problem to be Solved by the Invention

In Patent Document 1, the heat dissipation performance can be enhanced by the mounting portion.

Incidentally, similar to Patent Document 1, a lighting device is proposed, in which an LED circuit board and a reflection plate serving as an optical member are mounted in a device main body.

In the related-art lighting device, the LED circuit board is screwed directly to the device main body with the screws.

Consequently, in the related-art lighting device, stress applied to the LED circuit board by the screw tightening torque needs to be adjusted.

Therefore, the related-art lighting device cannot provide a good assembling performance.

In addition, in the related-art lighting device, it is necessary to select an LED circuit board which can bear the tightening axial force of the screws.

Consequently, such an LED circuit board that can bear the tightening axial force of the screws becomes expensive, and therefore, the related-art lighting device becomes disadvantageous in cost.

On the other hand, similar to Patent Document 1, a lighting device is proposed, in which an LED circuit board is supported by a resin reflection plate.

However, in the related-art lighting device, in order to increase the heat resistant properties of the resin reflection plate against increased heat resulting from higher outputs of recent LEDs, it is necessary to consider that high heat resistant properties be required on the resin reflection plate.

However, with the related-art lighting device, it is difficult to require high heat resistant properties on the resin reflection plate.

Consequently, with the related-art lighting device, the increase in output of the LEDs is limited.

The invention has been made with a view to solving the above-described problem, and an object thereof is to provide a lighting device which can provide a good assembling performance, which is advantageous in cost and which can deal with LEDs of higher outputs.

Means for Solving the Problem

A lighting device of the invention includes: a device main body; an LED unit which is mounted on a bottom surface of the device main body and which includes a plurality of LEDs which are mounted on a plurality of LED circuit boards; an optical member which is mounted on the device main body on a front side of the LED unit; and an LED circuit board pressing spring which supports the LED circuit boards in the device main body.

In the lighting device of the invention, the LED circuit board pressing spring presses the plurality of LED circuit boards such that LED circuit boards adjacent to each other are pressed together.

In the lighting device of the invention, the optical member includes a projecting portion which presses the LED circuit board pressing spring.

In the lighting device of the invention, the LED circuit board pressing spring has integrally a function to support the LED circuit boards in the device main body and a function to press the plurality of LED circuit boards such that LED circuit boards adjacent to each other are pressed together.

The lighting device of the invention further includes a pressing plate which presses the optical member to the device main body.

In the lighting device of the invention, the LED circuit board pressing spring includes a plurality of LED circuit board pressing portions which press the plurality of LED circuit boards.

Advantages of the Invention

The lighting device according to the invention is advantageous in providing the good assembling performance, providing better cost, and dealing with LEDs of higher outputs.

MODE FOR CARRYING OUT THE INVENTION

Hereinafter, a lighting device of an embodiment according to the invention will be described by reference to the drawings.

Figure 1:
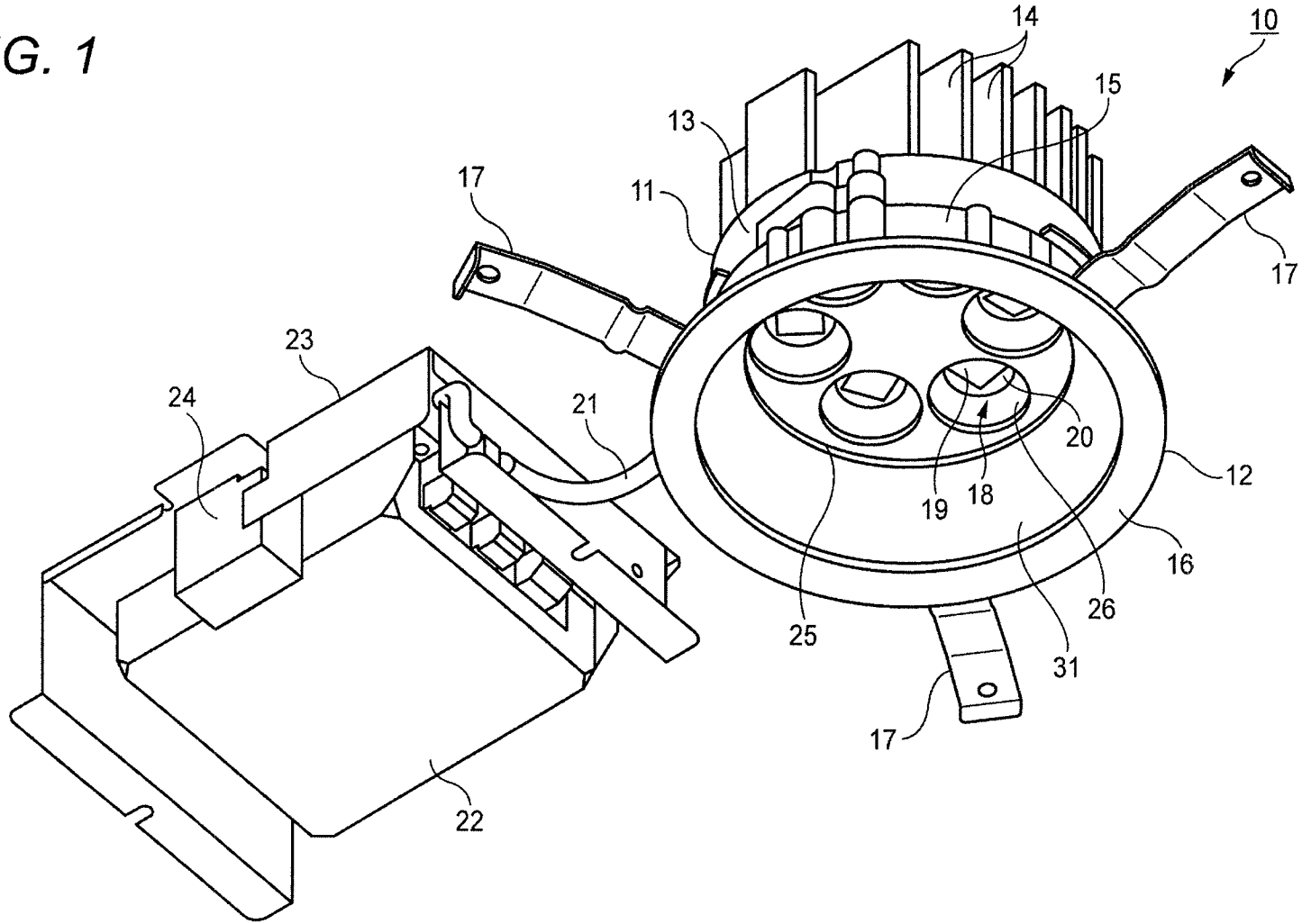
FIG. 1 is an external perspective view of a lighting device of an embodiment according to the invention as seen obliquely from therebelow.

As shown in FIG. 1, a lighting device 10 according to an embodiment of the invention includes a device main body 11 and a frame member 12 which is mounted underneath the device main body 11 and is installed into a storing hole opened in a ceiling material, not shown, for application to a downlight.

The device main body 11 is made of metal such as die-cast aluminum and has a substantially circular cylindrical portion 13, having a plurality of heat dissipating fins 14 on an upper portion of the cylindrical portion 13.

The frame member 12 has a cylindrical portion 15 which is formed of, for example, a hard resin material and a flange-shaped decorative plate 16 at a lower end portion of the cylindrical portion 15, and a plurality of mounting springs 17 are attached to a side portion of the cylindrical portion 15.

In the lighting device 10, an LED unit 18 is mounted in a bottom portion of the device main body 11.

In the LED unit 18, a plurality of LED chips 19 are sealed up on corresponding LED circuit boards 20, and printed circuits, not shown, provided on the LED circuit boards 20 are electrically connected to a power supply unit 22 through a device wiring 21.

The power supply unit 22 is accommodated in a power supply case 23, and the power supply case 23 is screwed to the upper portion of the device main body 11. The power supply unit 22 includes a power supply terminal base 24.

Figure 2:
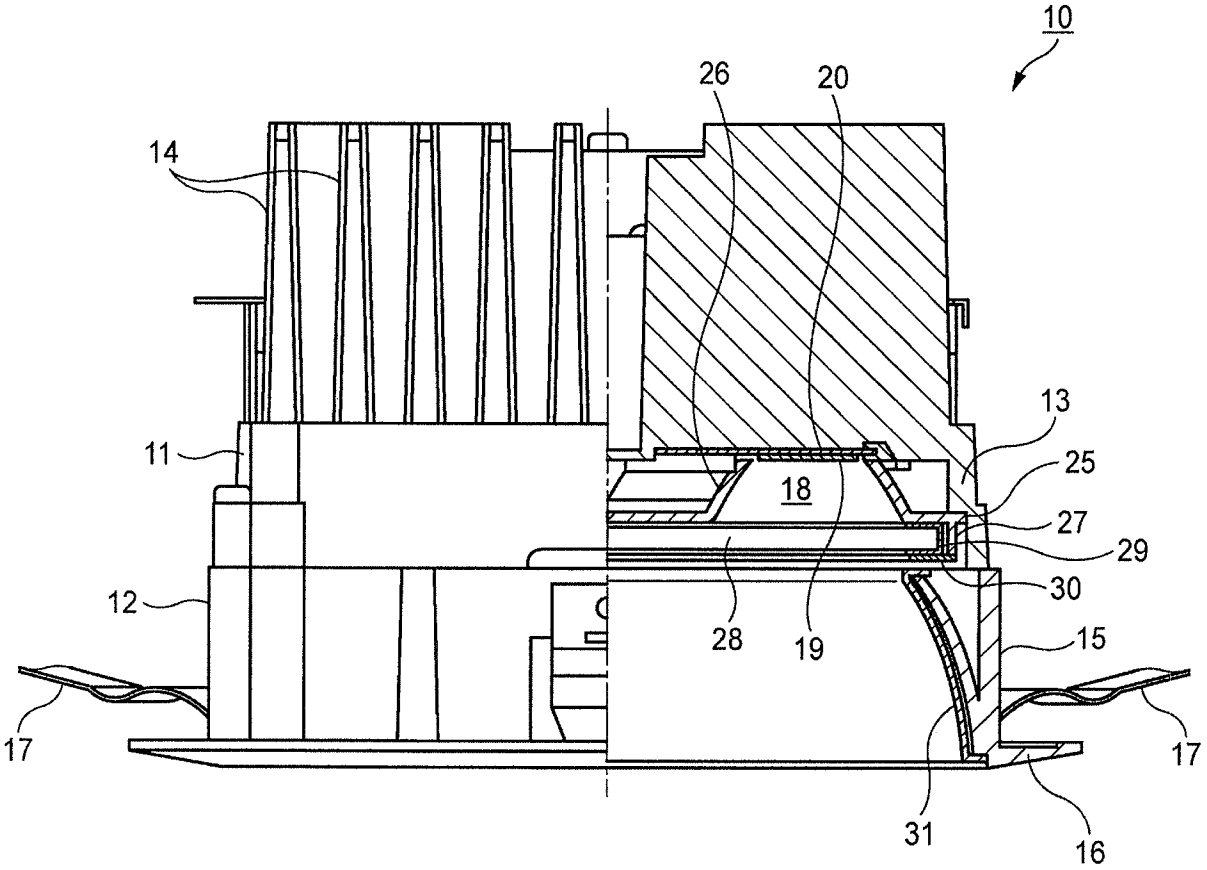
FIG. 2 is a partially cutaway side view of the lighting device of the embodiment according to the invention.

As shown in FIG. 2, in the lighting device 10, a reflection plate 25, which is a resin optical member, is mounted directly below the LED unit 18.

It is noted that a lens element can also be adopted as an optical member in place of the reflection plate 25.

The reflection plate 25 has a plurality of reflection surfaces 26 each having a substantially semispherical shape and opened in a top portion in positions corresponding individually to the LED chips 19 of the LED unit 18.

The reflection plate 25 has an outer frame 27 on an outer circumferential portion thereof, and a translucent or transparent resin panel 28 is accommodated inside of the outer frame 27.

The reflection plate 25 is fixed to the device main body 11 via an endless annular packing 29 and an annular pressing plate 30. The packing 29 accommodates the panel 28.

The frame member 12 has an auxiliary reflection plate 31 having a substantially semispherical shape and opened in a top portion on an inner circumferential surface thereof.

Next, an assembling procedure of the lighting device 10 including a detailed construction thereof will be described. It is noted that in Figs. from 3 onward, the lighting device is shown upside down compared with that shown in FIGS. 1 and 2.

Figure 3:
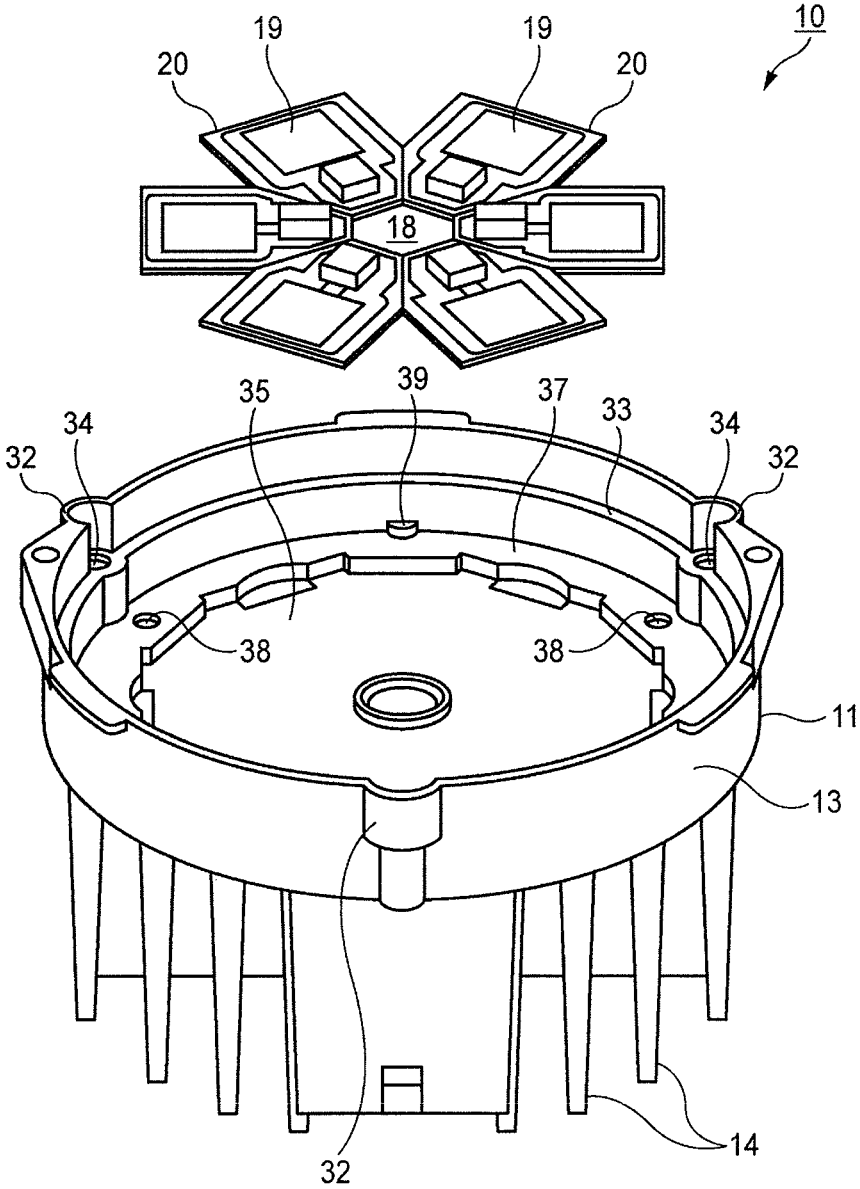
FIG. 3 is an exploded perspective view illustrating a first step of a mounting procedure of the lighting device of the embodiment according to the invention.

As shown in FIG. 3, the device main body 11 has a plurality of projecting accommodating portions 32 on an outer circumferential portion of the cylindrical portion 13 in positions which are located circumferentially at equal intervals.

The device main body 11 has a reflection plate mounting surface 33 on an inner circumferential portion of the cylindrical portion 13 and has screw holes 34 in the reflection plate mounting surface 33 at bottom portions of the projecting portion accommodating portions 32.

The device main body 11 has, on a bottom surface thereof, an LED mounting surface 35 and has a spring mounting surface 37 to which an LED circuit board pressing spring 36 is fixed on an outer circumferential portion of the LED mounting surface 35, and a plurality of screw holes 38 are formed in the spring mounting surface 37.

The device main body 11 has a plurality of positioning projections 39 which are formed into small projections on an outer circumferential portion of the spring mounting surface 37 so as to position the LED circuit board pressing spring 36.

In a first step of the assembling procedure, the plurality of LED circuit boards 20 of the LED unit 18 are disposed on the LED mounting surface 35 of the device main body 11.

In the LED unit 18, the plurality of LED circuit boards 20 are radially arranged, and the plurality of LED circuit boards 20 are recessed onto the LED mounting surface 35 of the device main body 11.

As shown in FIG. 2, in a second step of the assembling procedure, the LED circuit board pressing spring 36 is disposed on the plurality of LED circuit boards 20 which are recessed onto the LED mounting surface 35.

The LED circuit board pressing spring 36 has an annular spring main body 40 which is thin and which has an elastic repulsive force and a plurality of pressing pieces 41 which each have a substantially curvilinear triangular shape so as to project toward an inner circumferential portion of the spring main body 40.

In the LED circuit board pressing spring 36, each pressing piece 41 has a pair of proximal LED circuit board pressing portions 42 at both side portions of a side of the pressing piece 41 which faces the spring main body 40 and a single distal LED circuit board pressing portion 43 at a distal end portion of the pressing piece 41.

The LED circuit board pressing spring 36 has notches 44 in an outer circumferential portion of the spring main body 40 in positions which coincide with the screw holes 38 in the spring mounting surface 37 of the device main body 11 and has notches 45 in positions which coincide with the positioning projections 39 of the device main body 11.

Figure 5:
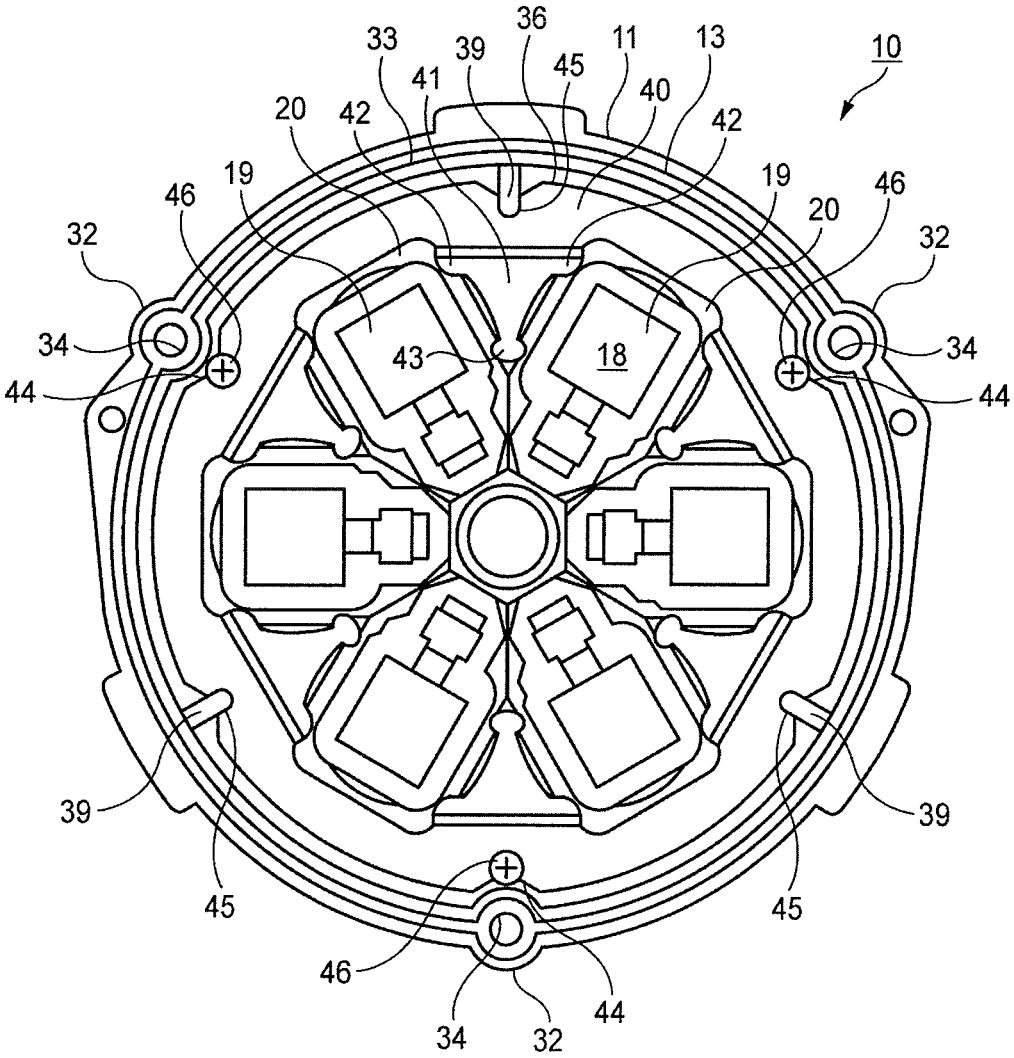
FIG. 5 is a plan view of the lighting device of the embodiment according to the invention after the completion of the second step.

Then, as shown in FIG. 5, the LED circuit board pressing spring 36 is mounted on an upper portion of the LED unit 18.

As this occurs, the LED circuit board pressing spring 36 is positioned in the device main body 11 by the notches 45 being fitted on the corresponding positioning projections 39 of the device main body 11.

In addition, in the LED circuit board pressing spring 36, the notches 44 coincide with the screw holes 38 in the spring mounting surface 37 of the device main body 11, and screws 46 are screwed into the screw holes 38.

Then, when the LED circuit board pressing spring 36 is screwed to the spring mounting surface 37, the pairs of proximal LED circuit board pressing portions 42 of the pressing pieces 41 press the adjacent LED circuit boards 20 to the device main body 11.

At the same time, in the LED circuit board pressing spring 36, the distal LED circuit board pressing portions 43 of the pressing pieces 41 press the adjacent LED circuit boards 20 to the device main body 11.

Because of this, the pairs of proximal LED circuit board pressing portions 42 and the distal LED circuit board pressing portions 43 of the LED circuit board pressing spring 36 press a plurality of positions of the adjacent LED circuit boards 20, and therefore, stress from the LED circuit board pressing spring 36 to the LED circuit boards 20 is dispersed.

Consequently, the plurality of LED circuit boards 20 can be pressed and supported stably in the device main body 11.

In addition, the LED circuit boards 20 which constitute a main heat source can be heat connected to the device main body 11 which constitutes a heat dissipating medium in an ensured fashion.

Figure 6:
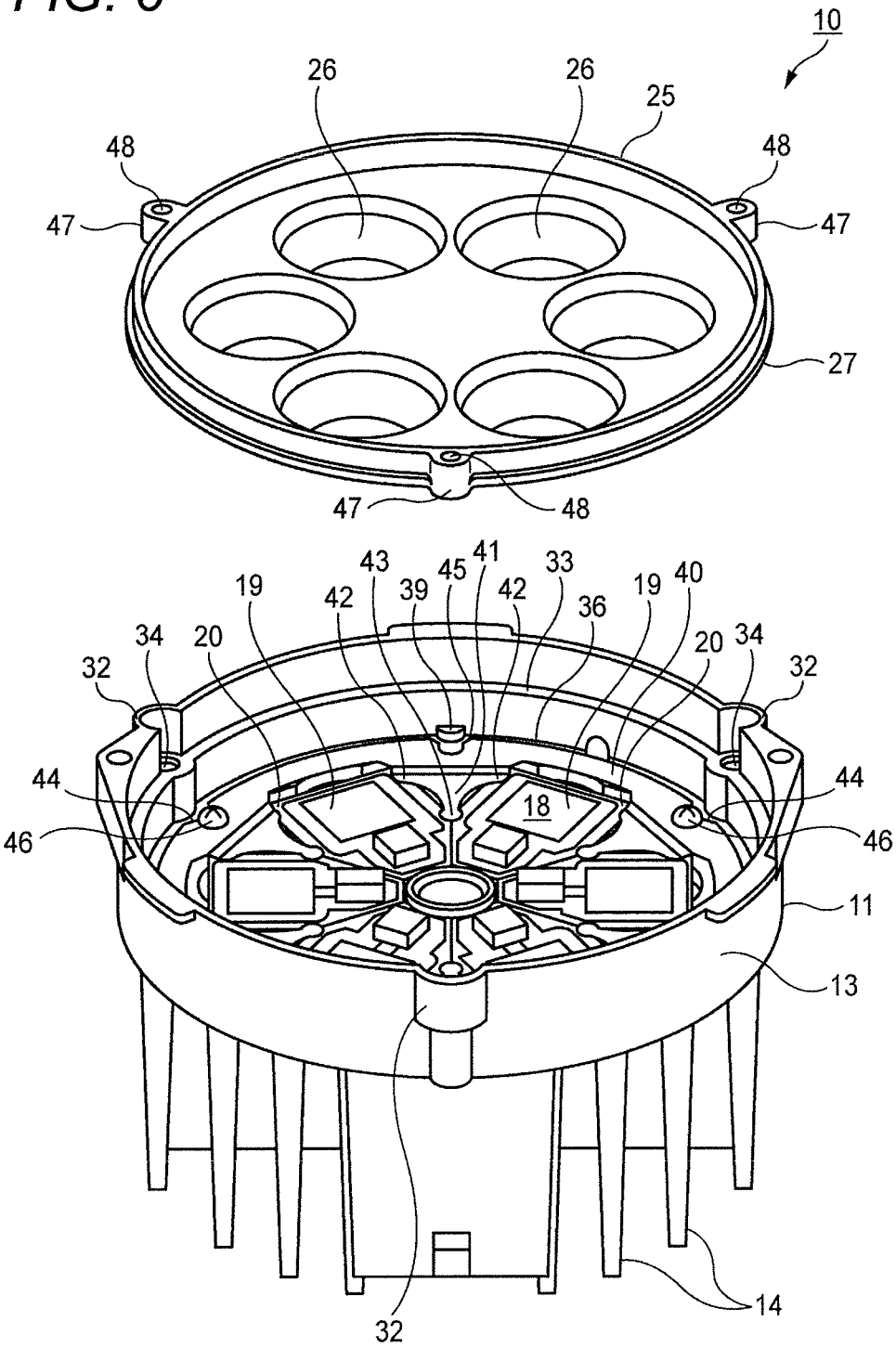
FIG. 6 is an exploded perspective view illustrating a third step of the mounting procedure of the lighting device of the embodiment according to the invention.

As shown in FIG. 6, in a third step of the assembling procedure, the reflection plate 25 is disposed on the upper portion of the LED unit 18.

The reflection plate 25 has a plurality of projecting portions 47 corresponding to the projecting portion accommodating portions 32 of the device main body 11 on an outer circumferential portion of the outer frame 27 in positions which are spaced circumferentially at equal intervals, and screw holes 48 are provided individually in the projecting portions 47.

The reflection plate 25 is assembled inside the cylindrical portion 13 of the device main body 11 so that the projecting portions 47 are accommodated individually in the corresponding projecting portion accommodating portions 32 of the device main body 11.

Figure 7:
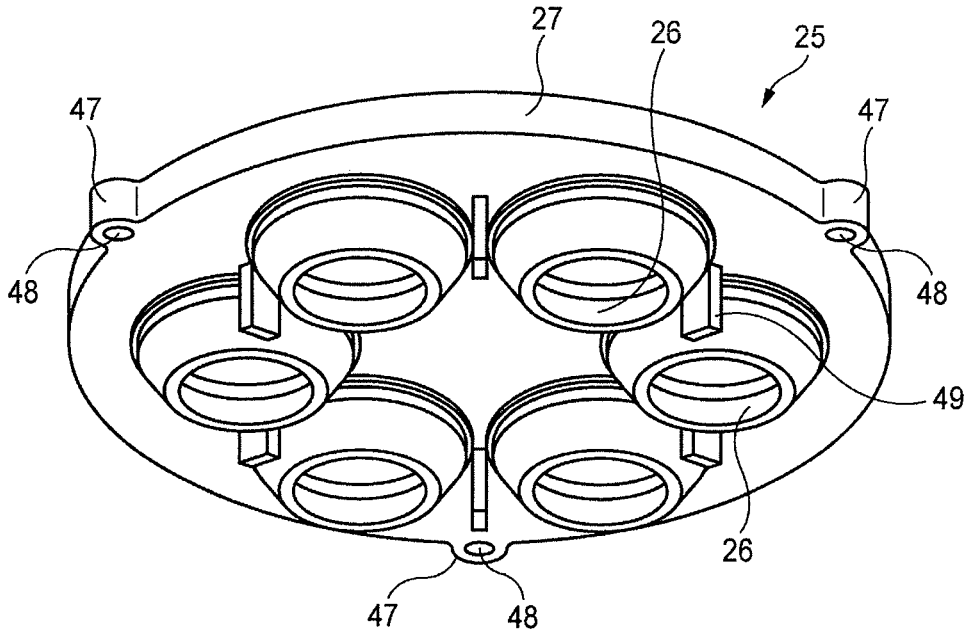
FIG. 7 is an external perspective view of a reflection plate of the lighting device of the embodiment according to the invention as seen obliquely from therebelow.

As shown in FIG. 7, the reflection plate 25 includes pressing projecting portions 49 which are provided between the reflection surfaces 26 on a rear surface thereof so as to press the pressing pieces 41 of the LED circuit board pressing spring 36 to the device main body 11.

Then, the reflection plate 25 is recessed onto the reflection mounting surface 33 of the device main body 11.

In the reflection plate 25, the projecting portions 47 are inserted individually into the corresponding projecting portion accommodating portions 32 of the device main body 11, whereby the outer frame 27 is assembled onto the reflection plate mounting surface 33 of the device main body 11.

Figure 8:
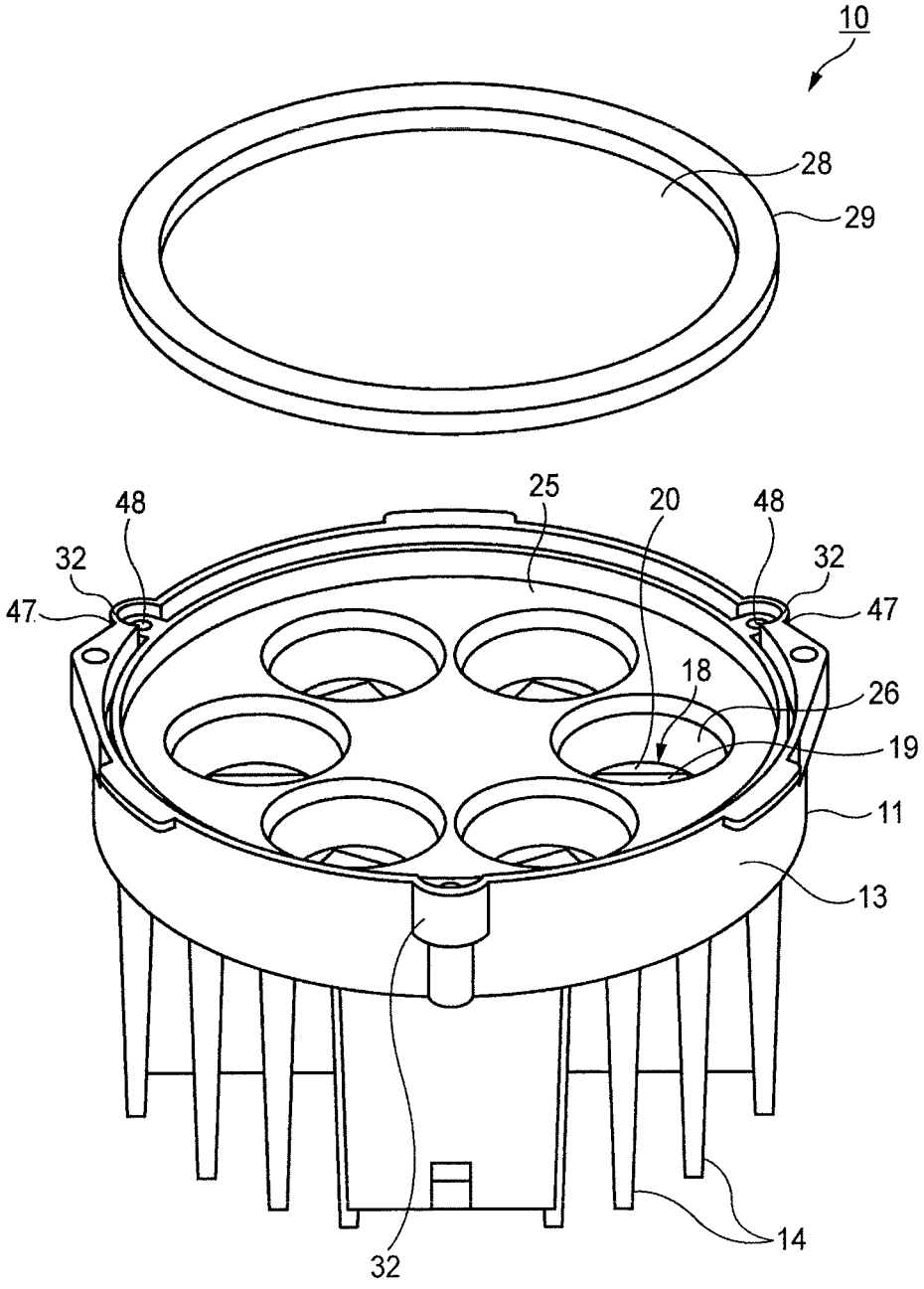
FIG. 8 is an exploded perspective view illustrating a fourth step of the mounting procedure of the lighting device of the embodiment according to the invention.

As shown in FIG. 8, in a fourth step of the assembling procedure, the packing 29 and the panel 28 which is mounted in the packing 29 are assembled onto an upper portion of the reflection plate 25.

As this occurs, the projecting portions 47 are inserted individually into the corresponding projecting portion accommodating portions 32 of the device main body 11, whereby the reflection plate 25 is positioned in place.

Figure 9:
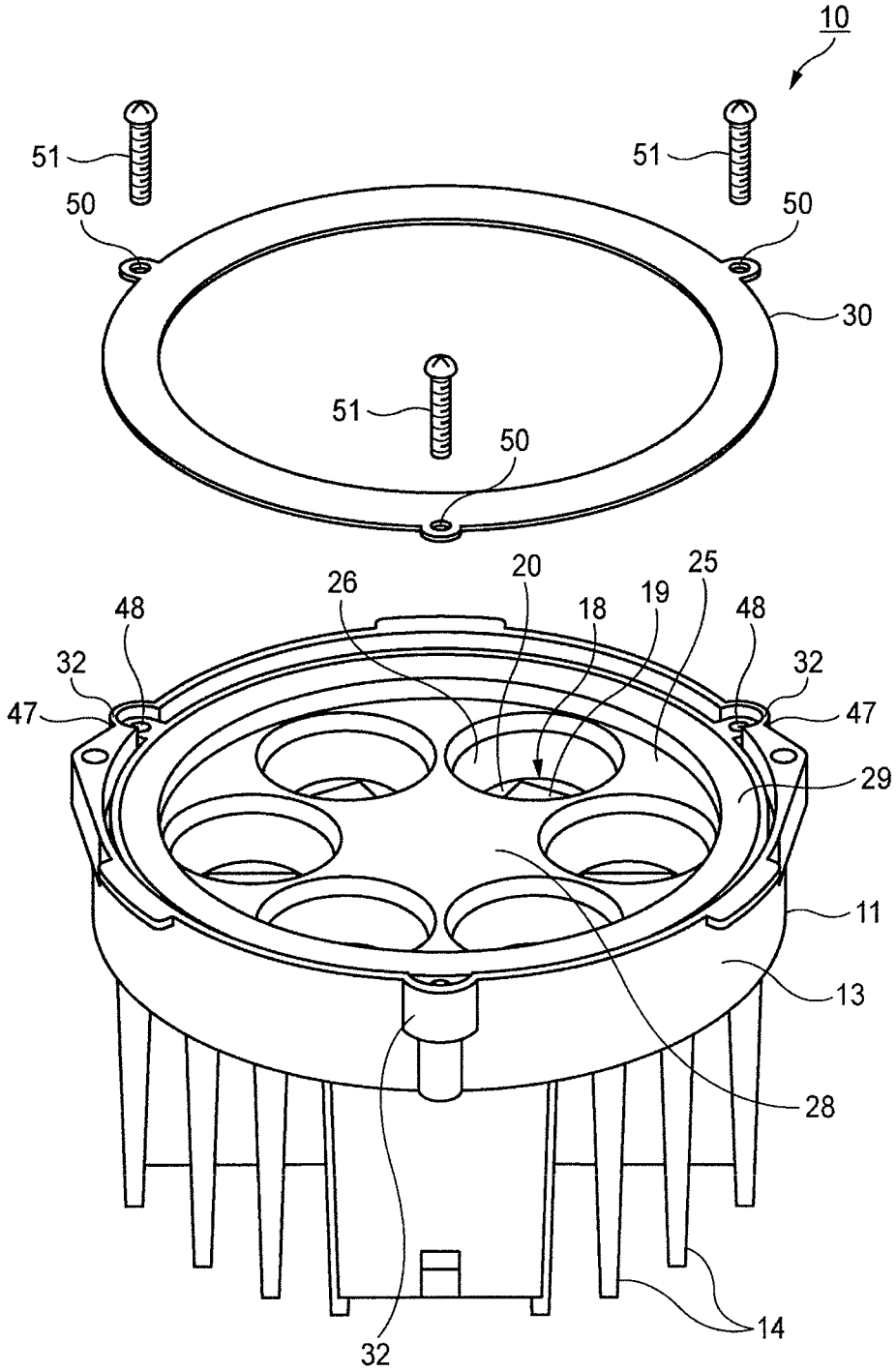
FIG. 9 is an exploded perspective view illustrating a fifth step of the mounting procedure of the lighting device of the embodiment according to the invention.

As shown in FIG. 9, in a fifth step in the assembling procedure, the pressing plate 30 is disposed on an upper portion of the packing 29.

In the pressing plate 30, screws 51 are inserted into the screw holes 48 in the projecting portions 47 of the reflection plate 25 from screw holes 51 provided in an outer circumferential portion of the pressing plate 30. Then, the screws 51 are screwed into the screw holes 34 through the screw holes 51.

The pressing projecting portions 49 on the reflection plate 25 press the pressing pieces 41 of the LED circuit board pressing spring 36 by the pressing plate 30 being screwed to the device main body 11.

Figure 4:
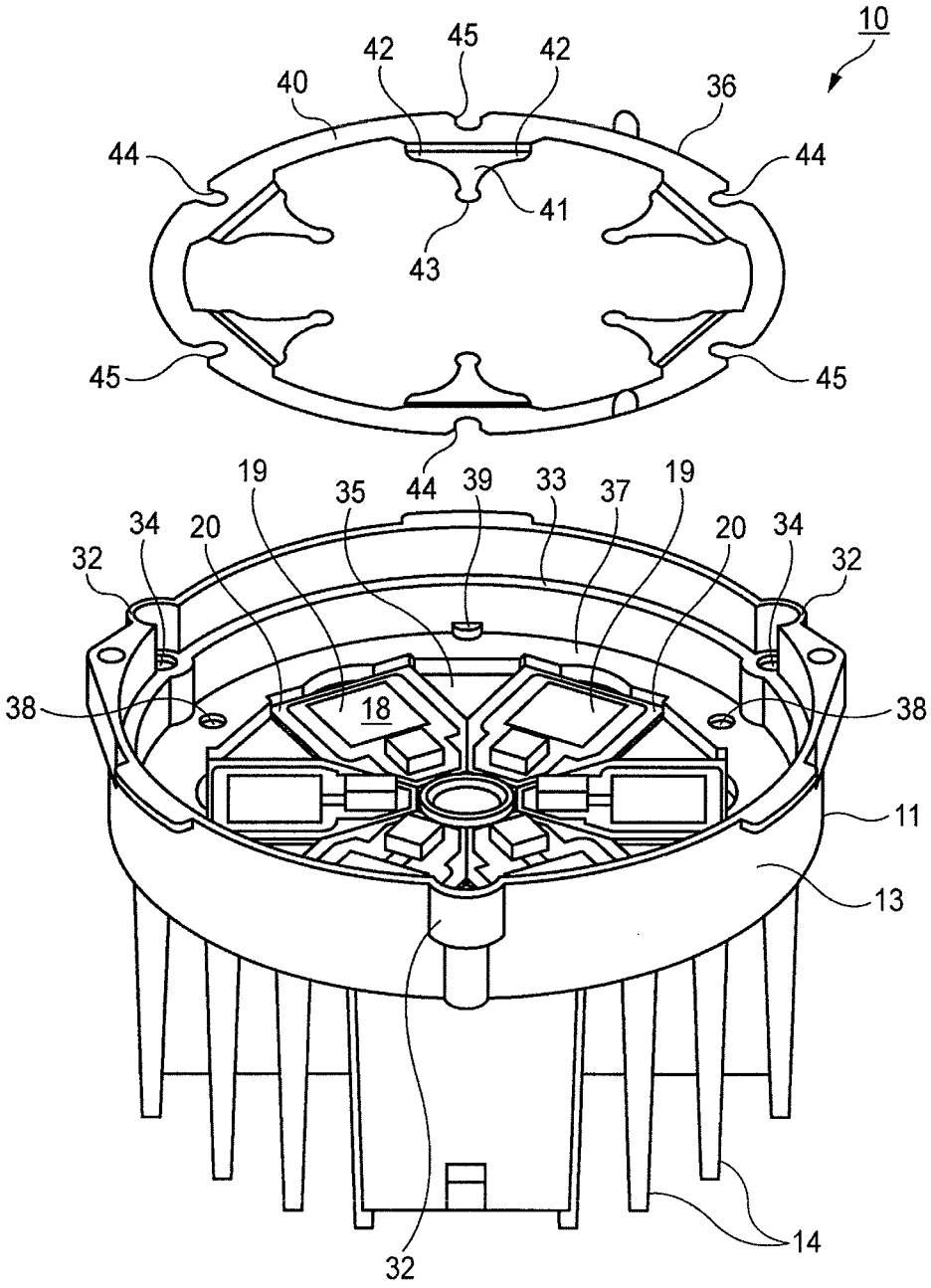
FIG. 4 is an exploded perspective view illustrating a second step of the mounting procedure of the lighting device of the embodiment according to the invention.

Consequently, the LED circuit boards 20 can be supported stably by virtue of an elastic restoration force which is accumulated in the pressing pieces 41 (refer to FIGS. 4, 5) of the LED circuit board pressing spring 36.

Figure 10:
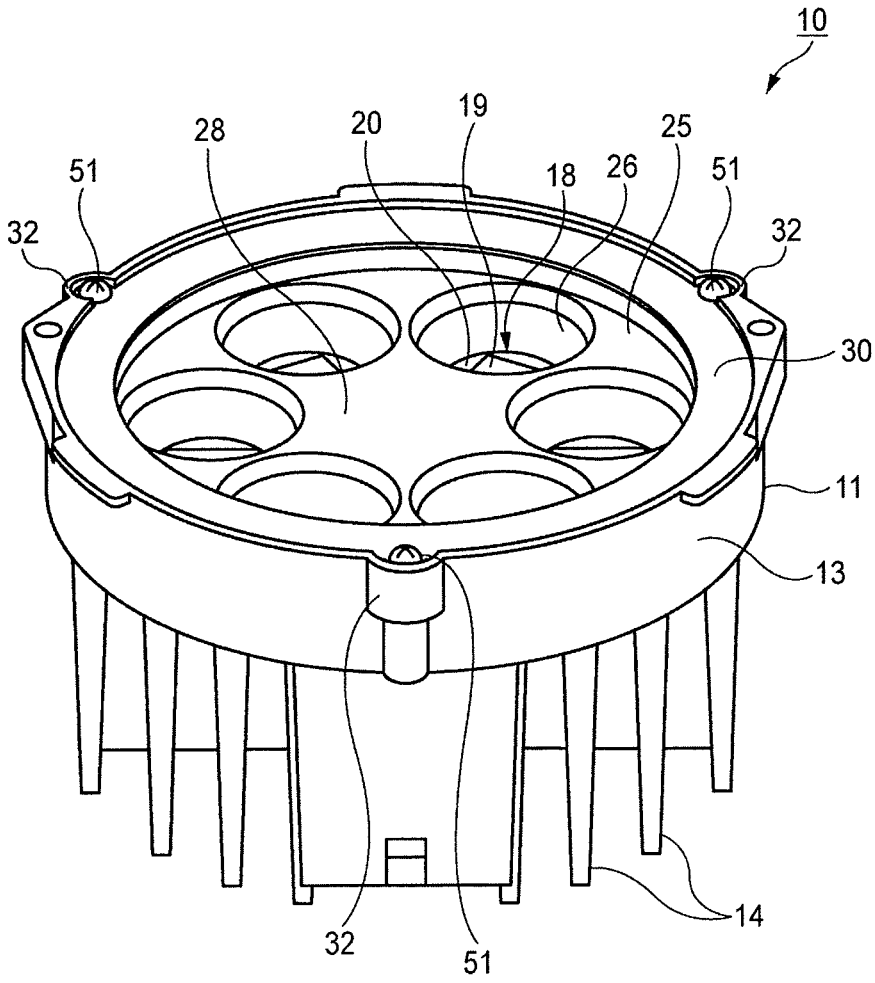
FIG. 10 is an external perspective view of the lighting device of the embodiment according to the invention after the completion of the fifth step of the mounting procedure.

As shown in FIG. 10, when the fifth step of the assembling procedure is completed whereupon the pressing plate 30 is screwed accordingly, pressing stress is imparted from the pressing plate 30 to the pressing pieces 41 of the LED circuit board pressing spring 36 via the pressing projecting portions 49 of the reflection plate 25.

Then, the LED circuit boards 20 are pressed to the device main body 11 by virtue of the elastic restoration force accumulated in the pressing pieces 41 (refer to FIGS. 4, 5) of the LED circuit board pressing spring 36.

Figure 11:
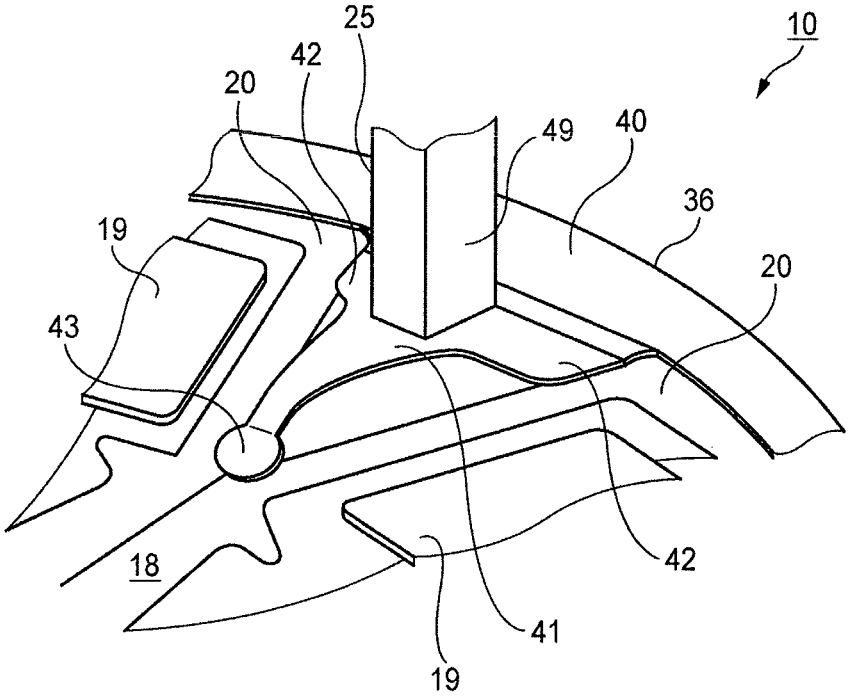
FIG. 11 is an external perspective view of the periphery of an LED circuit board pressing spring of the lighting device of the embodiment according to the invention.
Figure 12:
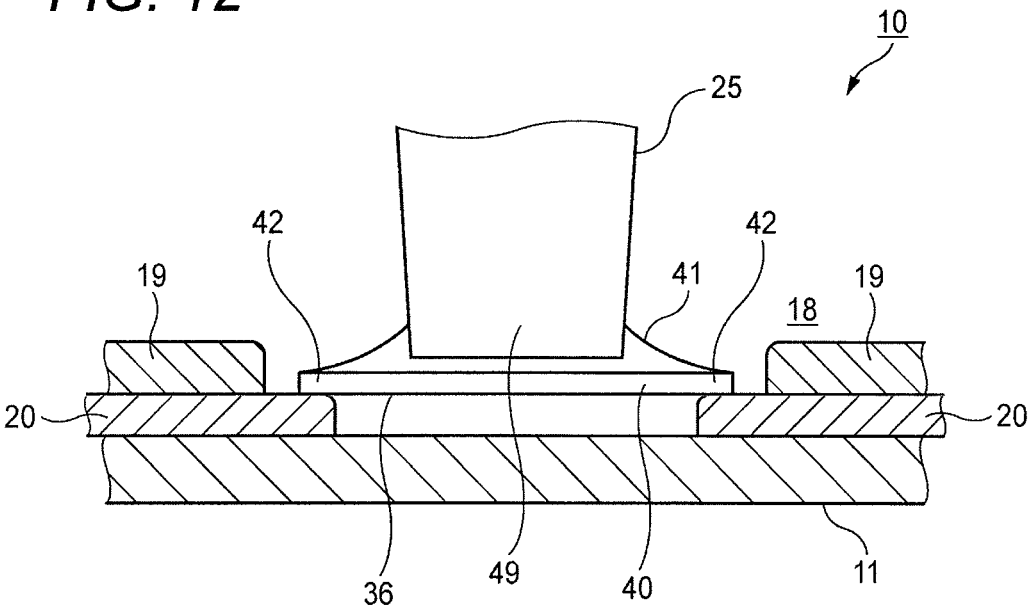
FIG. 12 is a partially cutaway vertical sectional view of a device main body, the LED circuit board pressing spring and the reflection plate of the lighting device of the embodiment according to the invention.

As shown in FIGS. 11 and 12, in the LED circuit board pressing spring 36, the pairs of proximal LED circuit board pressing portions 42 and the distal LED circuit board pressing portions 43 of the pressing pieces 41 press the plurality of LED circuit boards 20 so as to press LED circuit boards 20 adjacent to each other together.

Consequently, since the LED circuit board pressing spring 36 presses the adjacent LED circuit boards 20, there is caused no error in mounting the adjacent LED circuit boards 20, thereby making it possible to increase the mounting accuracy of the LED circuit boards 20.

The LED circuit board pressing spring 36 has a function to support the LED circuit boards 20 on the device main body 11 and a function to press the adjacent LED circuit boards 20 together.

Because of this, in the assembling work, since only the single LED circuit board pressing spring 36 is mounted, the number of man-hours can be reduced remarkably by the simple assembling work.

Figure 13:
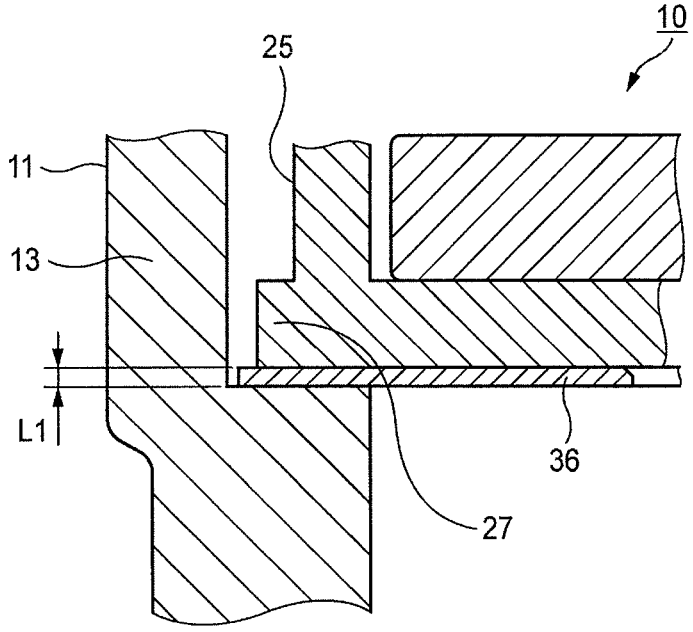
FIG. 13 is a partially cutaway vertical sectional view of the device main body and the reflection plate of the lighting device of the embodiment according to the invention.

As shown in FIG. 13, a gap dimension L1 is provided between the device main body 11 and the reflection plate 25.

Then, by the pressing plate 30 being screwed to the device main body 11, the resilient restoration force accumulated in the LED circuit board pressing spring 36 which is pressed by the reflection plate 25 is imparted to the reflection plate 25 and the LED circuit boards 20.

Because of this, the pressing projecting portions 49 of the reflection plate 25 press the pressing pieces 41 of the LED circuit board pressing spring 36 within a range of the gap dimension L1.

Consequently, the pressing stress to the LED circuit boards 20 can be optimized, and the LED circuit boards 20 can be mounted in the device main body 11 in an ensured fashion.

Thus, according to the lighting device 10 of the embodiment according to the invention that has been described heretofore, since the LED circuit boards 20 are supported in the device main body 11 by the LED circuit board pressing spring 36, although in the related-art lighting device, the stress applied to the LED circuit boards by virtue of the tightening torque of the screws needs to be taken into consideration, according to the lighting device 10 of the invention, the stress does not have to be taken into consideration.

Consequently, according to the lighting device 10, the assembling performance can be improved.

In addition, although in the related-art lighting device, the LED circuit boards are supported by the reflection plate, according to the lighting device 10, the LED circuit boards are not supported by the reflection plate.

Consequently, according to the lighting device 10, since the inexpensive resin LED circuit boards 20 can be adopted, the lighting device 10 is advantageous in terms of costs.

Additionally, although in the related-art lighting device, the LED circuit boards are supported by the reflection plate, according to the lighting device 10, the LED circuit boards are not supported by the reflection plate, and therefore, high heat resistant properties do not have to be required on the resin reflection plate 25 in order to increase the heat resistant properties of the reflection plate to deal with LED units 18 of higher outputs.

Consequently, according to the lighting device 10, it is possible to deal with LED units 18 of higher outputs.

In addition, according to the lighting device 10 of the embodiment, in the LED circuit board pressing spring 36, the pairs of proximal LED circuit board pressing portions 42 and the distal LED circuit pressing portions 43 of the pressing pieces 41 press the plurality of adjacent LED circuit boards 20 together.

Consequently, according to the lighting device 10, since the LED circuit board pressing spring 36 presses the adjacent LED circuit boards 20, no mounting error is caused between the adjacent LED circuit boards 20, thereby making it possible to enhance the mounding accuracy of the LED circuit boards 20.

Additionally, according to the lighting device 10 of the embodiment, when the LED circuit board pressing spring 36 is mounted in the device main body 11, the pressing projecting portions 49 of the reflection plate 25 press the pressing pieces 41 of the LED circuit board pressing spring 36.

Consequently, according to the lighting device 10, the pressing stress applied to the LED circuit boards 20 can be optimized, thereby making it possible to mount the LED circuit boards 20 in the device main body 11 in an ensured fashion.

Further, according to the lighting device 10 of the embodiment, the LED circuit board pressing spring 36 has integrally the function to support the LED circuit boards 20 on the device main body 11 and the function to press the adjacent LED circuit boards 20 together.

Consequently, the assembling work involves only the mounting of the single LED circuit board pressing spring 36, thereby making it possible to reduce largely the number of man-hours by the simple assembling work.

Further, according to the lighting device 10 of the embodiment, the pressing projecting portions 49 of the reflection plate 25 press the pressing pieces 41 of the LED circuit board pressing spring 36 by the pressing plate 30 being screwed to the device main body 11.

Consequently, according to the lighting device 10, the LED circuit boards 20 can be supported stably by virtue of the elastic restoration force accumulated in the pressing pieces 41 of the LED circuit board pressing spring 36.

In addition, according to the lighting device 10 of the embodiment, the pairs of proximal LED circuit board pressing portions 42 and the distal LED circuit board pressing portions 43 of the LED circuit board pressing spring 36 press a plurality of positions of the adjacent LED circuit boards 20.

Because of this, according to the lighting device 10, the stress from the LED circuit board pressing spring 36 to the LED circuit boards 20 is dispersed.

Consequently, according to the lighting device 10, the plurality of LED circuit boards 20 can be pressed to be supported stably in the device main body 11.

In addition, according to the lighting device 10, the LED circuit boards 20 which constitute the main heat source can be heat connected to the device main body 11 which constitutes the heat dissipating medium in an ensured fashion.

In the lighting device of the invention, the device main body, the frame members, the LED unit, the power supply unit and the mounting springs are not limited to the embodiment and hence can be modified or improved as required.

This patent application is based on Japanese Patent Application (No. 2011-122301) filed on May 31, 2011, the contents of which are incorporated herein by reference.

DESCRIPTION OF REFERENCE SIGNS

10: Lighting Device
11: Device Main Body
18: LED Unit
19: LED Chip (LED)
20: LED Circuit Board
25: Reflection Plate (Optical Member)
30: Pressing Plate
36: LED Circuit Board Pressing Spring
42: Proximal LED Circuit Board Pressing Portion (LED Circuit Board Pressing Portion)
43: Distal LED Circuit Board Pressing Portion (LED Circuit Board Pressing Portion)
49: Pressing Projecting Portion (Projecting Portion).

What is claimed is:

1. A lighting device comprising:

a device main body;

an LED unit which is mounted on a bottom surface of the device main body and which comprises a plurality of LEDs which are mounted on a plurality of LED circuit boards;

an optical member which is mounted on the device main body on a front side of the LED unit; and an LED circuit board pressing spring which supports the plurality of LED circuit boards in the device main body, wherein the optical member comprises a projecting portion which presses the LED circuit board pressing spring.

2. The lighting device according to claim 1, wherein the LED circuit board pressing spring presses the plurality of LED circuit boards such that LED circuit boards adjacent to each other are pressed together.

3. The lighting device according to claim 1, wherein the LED circuit board pressing has integrally a function to support the LED circuits boards in the device main body and a function to press the plurality of LED circuit boards such that LED circuits boards adjacent to each other are pressed together.

4. The lighting device according to claim 1, further comprising:

a pressing plate which presses the optical member to the device main body.

5. The lighting device according to claim 1, wherein the LED circuit board pressing spring comprises a plurality of LED circuit board pressing portions which press the plurality of LED circuit boards.

6. A lighting device comprising:

a device main body;

an LED unit which is mounted on a bottom surface of the device main body and which comprises a plurality of LEDs which are mounted on a plurality of LED circuit boards;

an optical member which is mounted on the device main body on a front side of the LED unit;

a pressing plate which presses the optical member to the device main body; and an LED circuit board pressing spring which supports the plurality of LED circuit boards in the device main body.

7. The lighting device according to claim 6, wherein the LED circuit board pressing spring presses the plurality of LED circuit boards such that LED circuit boards adjacent to each other are pressed together.

8. The lighting device according to claim 6, wherein the LED circuit board pressing spring has integrally a function to support the LED circuit boards in the device main body and a function to press the plurality of LED circuit boards such that LED circuit boards adjacent to each other are pressed together.

9. The lighting device according claim 6, further comprising:

a pressing plate which presses the optical member to the device main body.

10. The lighting device according to claim 6, wherein the LED circuit board pressing spring comprises a plurality of LED circuit board pressing portions which press the plurality of LED circuit boards.

* * * * *